US006165012A

United States Patent [19]

Abe et al.

[11] Patent Number: 6,165,012

[45] Date of Patent: Dec. 26, 2000

[54] PRESS-CONNECTING CONNECTOR

[75] Inventors: Kimihiro Abe; Kentaro Nagai; Tetsuya Yamashita, all of Shizuoka, Japan

[73] Assignee: Yazaki Corporation, Tokyo, Japan

[21] Appl. No.: 09/212,487

[22] Filed: Dec. 16, 1998

[30] Foreign Application Priority Data

Dec. 18, 1997 [JP] Japan ..... 9-349433

[51] Int. Cl.[7] ..... H01R 13/40

[52] U.S. Cl. ..... 439/596; 439/465; 439/746

[58] Field of Search ..... 439/596, 597, 439/598, 599, 399, 748, 465, 746

[56] References Cited

U.S. PATENT DOCUMENTS 4,243,288 1/1981 Lucius et al. ..... 339/99
4,435,035 3/1984 Berry et al. ..... 439/404
5,100,345 3/1992 Endo et al. ..... 439/595
5,683,272 11/1997 Abe ..... 439/747

*Primary Examiner*—Neil Abrams
*Assistant Examiner*—Michael C. Zarroli
*Attorney, Agent, or Firm*—Sughrue, Mion, Zinn, Macpeak & Seas, PLLC

[57] ABSTRACT

An opening 5 for press-connecting purposes is formed in one side of each of terminal receiving chambers 3, formed in a connector housing 1, at a rear portion thereof, and a retaining hole 9 is formed through one wall 7 of each of the terminal receiving chambers disposed forwardly of the opening 5, and the retaining hole communicates the interior and exterior of the associated terminal receiving chamber 3 with each other, and a resilient lance 13 of a terminal 43, received in the terminal receiving chamber 3, is engageable in the retaining hole 9. A cover 17 is releasably engaged with the connector housing 1 to cover the openings 5, and a closure portion 35 for covering the retaining holes 9 is formed on and extends from a front end of the cover 17.

15 Claims, 8 Drawing Sheets

PRESS-CONNECTING CONNECTOR

BACKGROUND OF THE INVENTION

1. Field of the Invention

This invention relates to a press-connecting connector in which wires are press-connected respectively to metal terminals received respectively in terminal receiving chambers in a connector housing.

2. Related Art

FIGS. 10 to 12 show one conventional press-connecting connector (U.S. Pat. No. 4,243,288). FIG. 10 is an exploded, perspective view, FIG. 11 is a perspective view showing an assembled condition, and FIG. 12 is an enlarged, cross-sectional view.

The press-connecting connector, shown in FIGS. 10 to 12, is of the male type, and includes a connector housing 1 having two (upper and lower) rows of juxtaposed terminal receiving chambers 3 (in the drawings, the upper row of terminal receiving chambers 3 are mainly shown). An opening 5 for press-connecting purposes is formed in one side (upper side) of each of the upper row of terminal receiving chambers 3 at a rear portion thereof while an opening 5 is formed in one side (lower side) of each of the lower row of terminal receiving chambers 3 at a rear portion thereof. Retaining holes 9 are formed through each of upper and lower walls 7, 8 of the connector housing 1, disposed forwardly of the openings 5, and each of the retaining holes 9 communicates the interior and exterior of the associated terminal receiving chamber 3 with each other.

FIG. 12 shows the cross-section of the upper terminal receiving chambers 3. A female metal terminal 11 is received in each terminal receiving chamber 3, and a resilient lance 13 is engaged in the retaining hole 9.

Wires 15, shown in FIG. 10, are press-connected respectively to the female metal terminals 11, and then covers 17 are releasably attached to the connector housing to cover the openings 5. Therefore, the press-connecting connector can be easily formed. For effecting the maintenance, a tool is inserted into the retaining hole 9 to flex the resilient lance 13, so that the metal terminal 11 can be easily withdrawn from the terminal receiving chamber 3.

However, in the above construction in which the retaining holes 9 are exposed to the exterior, foreign matter is liable to intrude into the terminal receiving chamber 3 through the retaining hole 9, and this leads to a possibility that this foreign matter projects into the adjacent terminal receiving chamber 3, thereby causing the short-circuiting, and besides there is a possibility that the engagement of the resilient lance is canceled by the foreign matter.

To deal with this, it may be proposed to use additional covers for covering the retaining holes 9. In this case, however, in addition to the covers for respectively covering the openings 5, the additional covers must be used, and therefore the number of the component parts increases, which leads to a possibility that the cost increases. And besides, retaining structures for respectively retaining the covers for covering the retaining holes 9 must be provided, which leads to a possibility that the construction becomes complicated. Furthermore, the attachment of the covers 17 for covering the openings 5 must be effected separately from the attachment of the covers for covering the retaining holes 9, and therefore the assembling operation and the maintenance are quite cumbersome.

SUMMARY OF THE INVENTION

It is therefore an object of this invention to provide a press-connecting connector in which the number of component parts is small, and retaining holes are closed with a simple construction.

According to a first aspect of the present invention, there is provided a press-connecting connector provided in that an opening for press-connecting purposes is formed in one side of each of terminal receiving chambers, formed in a connector housing, at a rear portion thereof, and a retaining hole is formed through one wall of each of the terminal receiving chambers disposed forwardly of the opening, the retaining hole communicates the interior and exterior of the associated terminal receiving chamber with each other, and a resilient lance of a terminal, received in the terminal receiving chamber, is engageable in the retaining hole; and a cover is releasably engaged with the connector housing to cover the openings; and a closure portion for covering the retaining holes is formed on and extends from a front end of the cover.

Therefore, when the cover is attached to the connector housing to cover the openings, the closure portion, formed at the front end of the cover, covers the retaining holes. When the cover is engaged with the connector housing, the closure portion, covering the retaining holes, is positioned relative to the connector housing.

In the press-connecting connector of the present invention, retaining portions are formed respectively at opposite sides of the terminal receiving chambers of the connector housing, and engagement portions for being releasably engaged respectively with the retaining portions are formed respectively at opposite sides of the cover.

Therefore, in addition to the effects of the present invention, when the cover is attached to the connector housing, the engagement portions of the cover are engaged respectively with the retaining portions, formed respectively at the opposite sides of the terminal receiving chambers, and thus the cover is releasably engaged with the connector housing.

In the press-connecting connector of the present invention, the connector housing has a wall portion extending upwardly at a region disposed forwardly of the retaining holes, and insertion reception portions are formed in the wall portion, and insertion portions for being received respectively in the insertion reception portions are formed on the closure portion formed at the front end of the cover.

Therefore, in addition to the effects of the present invention, when the cover is releasably engaged with the connector housing, the insertion portions, formed on the closure portion at the front end of the cover, are received respectively in the insertion reception portions formed in the wall portion disposed forwardly of the retaining holes in the connector housing.

In the press-connecting connector of the present invention, the retaining portions are retaining grooves, respectively, which are formed respectively at opposite sides of the connector housing at a rear end portion thereof, and extend in a forward-rearward direction, and the engagement portions are engagement projections, respectively, which are formed respectively at the opposite sides of the cover at a rear end portion thereof, and extend in the forward-rearward direction, and a lock retaining portion, having a retaining surface facing in the forward direction, is formed in each of the insertion reception portions, and a lock portion for engagement with the retaining surface of the associated lock retaining portion is formed on each of the insertion portions.

Therefore, in addition to the effects of the present invention, when the cover is attached to the connector housing, the engagement projections are engaged respectively in the retaining grooves in the upward-downward direction, and the lock portion of each insertion portion is retainingly engaged with the retaining surface facing in the forward-rearward direction in the insertion reception portion, and each insertion portion is engaged with the associated insertion reception portion in the upward-downward direction, and the lock portion is engaged with the retaining surface in the forward-rearward direction.

In the press-connecting connector of the present invention, the wall portion is a wall of a fitting hood of the connector housing.

Therefore, the effects of the present invention can be achieved by the press-connecting connector of the female type.

DETAILED DESCRIPTION OF THE PREFERRED EMBODIMENTS

First Embodiment

Figure 1:
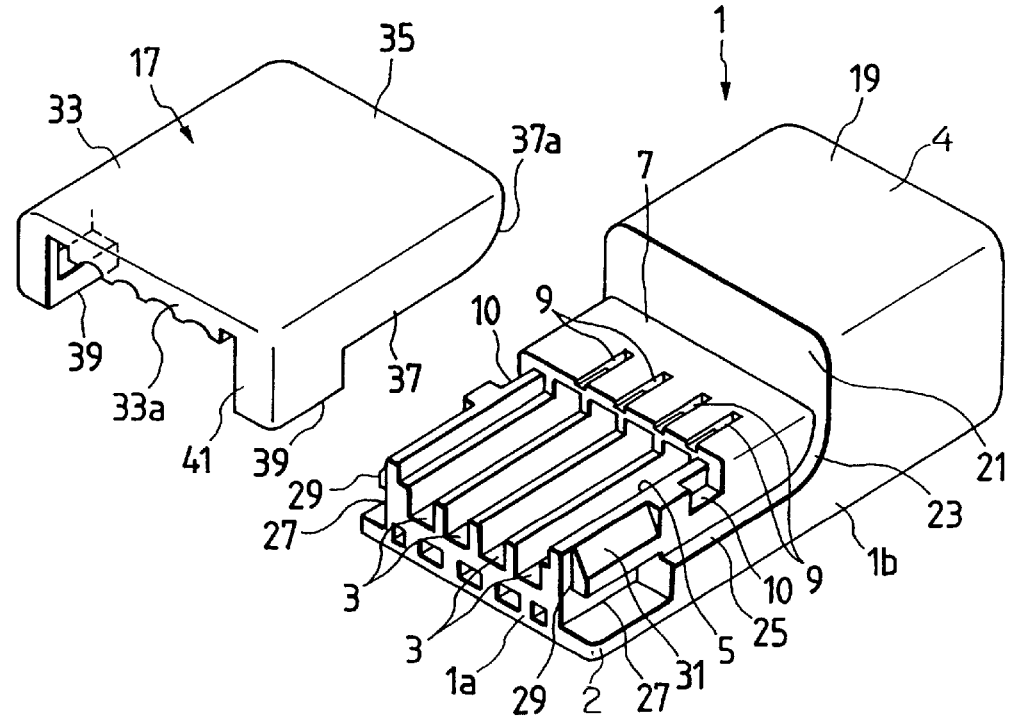
FIG. 1 is a perspective view of a first embodiment of the present invention, showing a condition in which a cover is detached from a connector housing.
Figure 2:
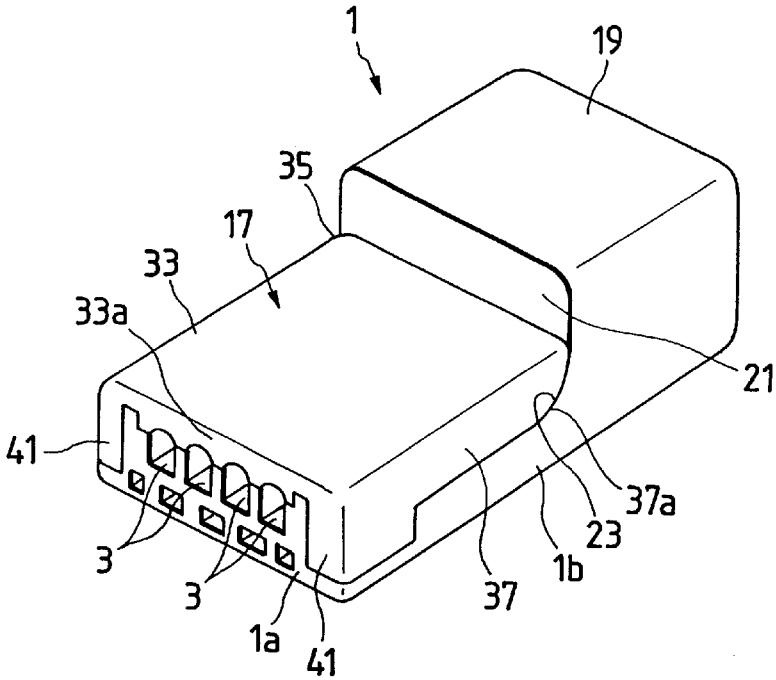
FIG. 2 is a perspective view of the first embodiment showing a condition in which the cover is attached.
Figure 3A:
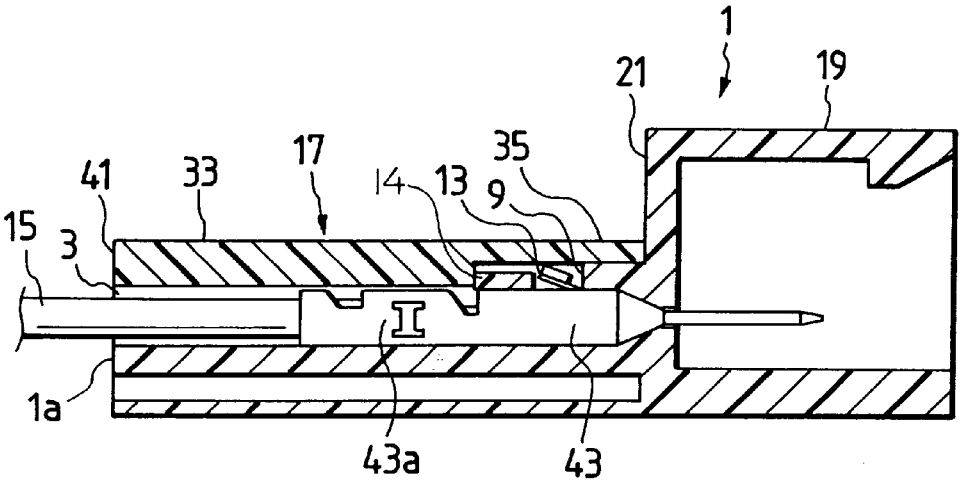
FIG. 3(*a*) is a cross-sectional view showing a condition in which the cover is attached, and FIG. 3(*b*) is a cross-sectional view showing a condition in which the cover is detached, and a press-connecting operation is not yet effected.
Figure 3B:
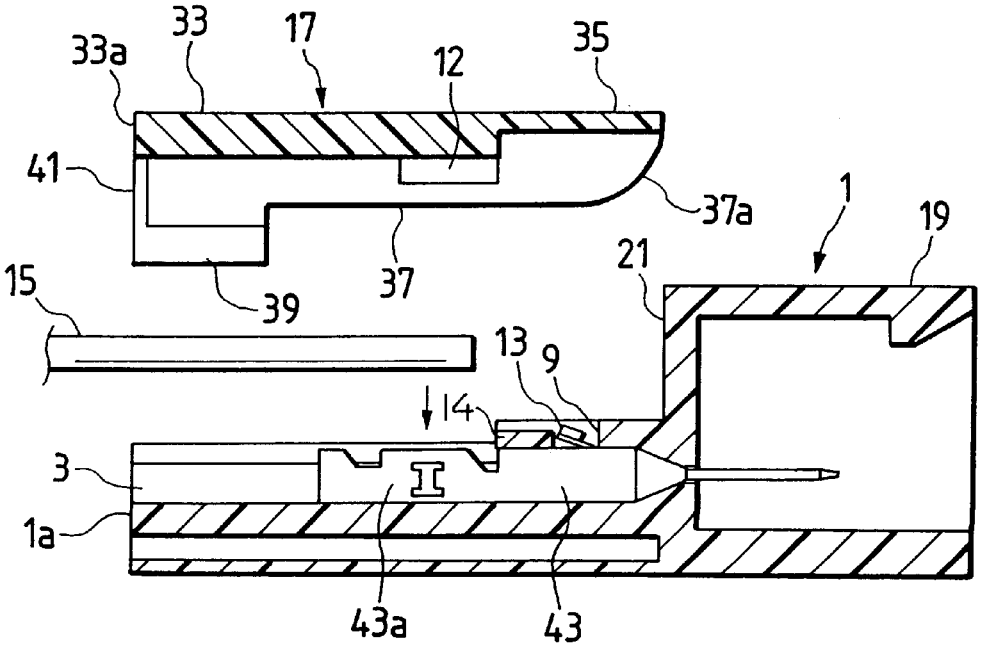
Figure 10:
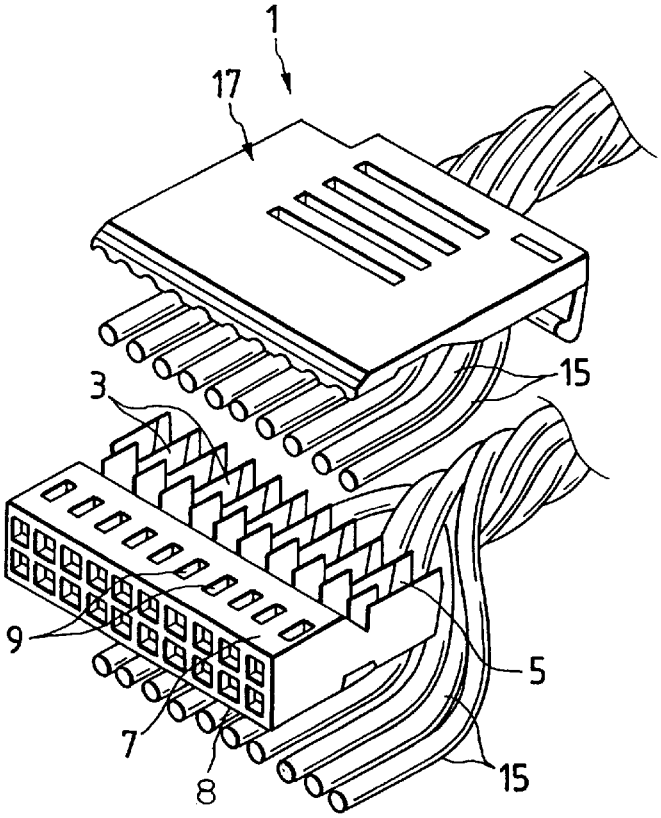
FIG. 10 is an exploded, perspective view of a conventional press-connecting connector.
Figure 11:
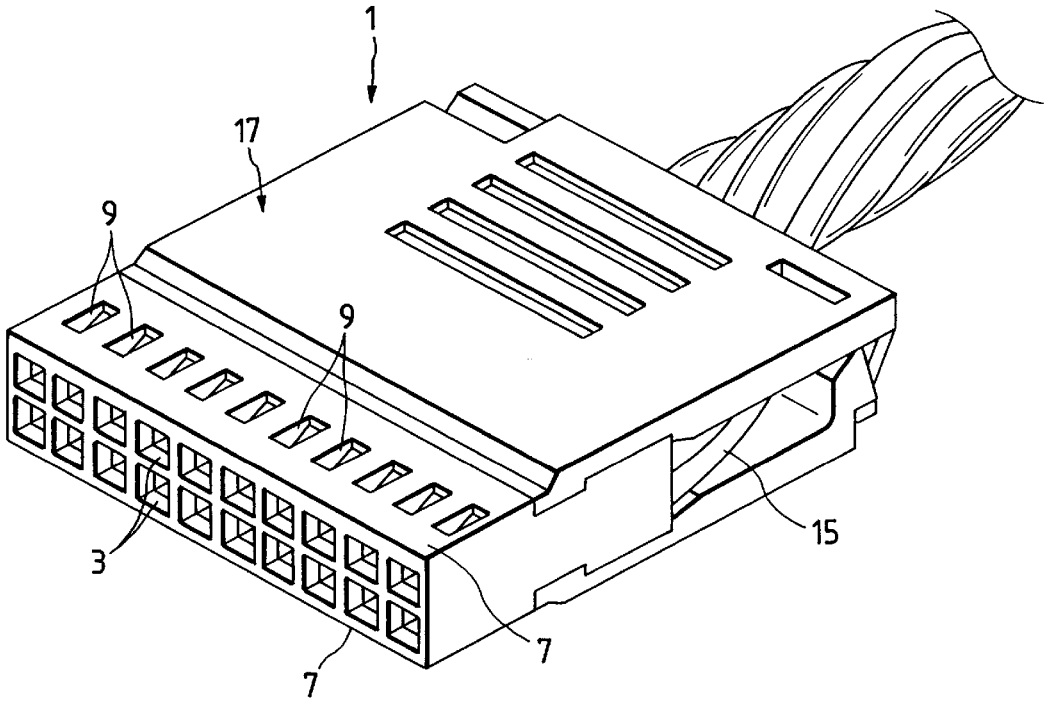
FIG. 11 is a perspective view of the conventional press-connecting connector in its assembled condition.
Figure 12:
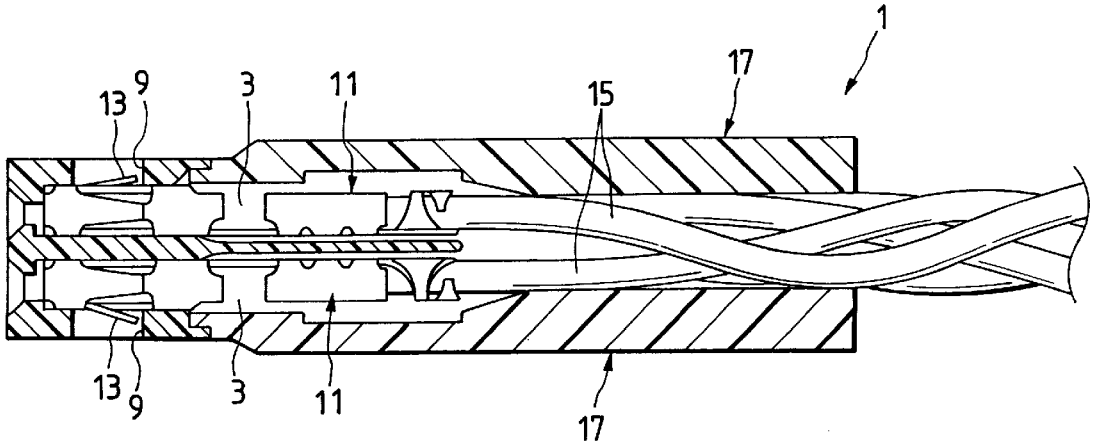
FIG. 12 is an enlarged, cross-sectional view of the conventional press-connecting connector.

FIGS. 1 to 3 show a first embodiment of the invention, and FIG. 1 is a perspective view showing a condition in which a cover is detached, FIG. 2 is a perspective view showing an assembled condition, and FIG. 3 is a cross-sectional view. Those constituent portions, corresponding respectively to those described above in FIGS. 10 and 12, will be designated by identical reference numerals, respectively, and detailed description thereof will be omitted.

As shown in FIGS. 1 to 3, a press-connecting connector of the first embodiment is of the female type, and a connector housing 1 includes terminal receiving chambers 3 formed in a rear portion 2 of the connector housing 1, openings 5, an upper wall 7, retaining holes 9, the cover 17, and a fitting hood 19 formed on a forward portion 4 of the connector housing.

The wall 7, through which the retaining holes 9 are formed, is raised or stepped relative to the openings 5. As shown in FIGS. 3(*a*) and 3(*b*), retaining portions 14 are formed in the retaining holes 9. The connector housing 1 has shelf portions 25 (extending in a forward-rearward direction) formed adjacent respectively to outer sides of the right-end and left-end terminal receiving chambers 3, and the shelf portions 25 are continuous with a rear wall 21 of the fitting hood 19 through respective curved portions 23. Retaining grooves (retaining portions) 27 are formed respectively at the outer sides of the right-end and left-end terminal receiving chambers 3, and are disposed rearwardly of the shelf portions, respectively. The retaining grooves 27 are open to a rear end of the connector housing 1, and notch portions 29 are formed in a rear end surface 1*a* of the connector housing 1, and are disposed above the retaining grooves 27, respectively. The connector housing 1 has guide surfaces 31 which are provided forwardly of the notch portions 29, respectively, and are disposed above the retaining grooves 27, respectively, the guide surfaces 31 being slanting downwardly outwardly.

The cover 17 includes a cover body 33, and a closure portion 35 for covering the retaining holes 9 is formed integrally at a front end of the cover body 33. Side walls 37 are formed on and extend downwardly respectively from opposite sides of the cover body 33 and also from opposite sides of the closure portion 35. Engagement projections (engagement portions) 39 are formed integrally on and extend downwardly respectively from the opposite side walls 37 at the rear end portion of the cover body 33, the engagement projections 39 projecting inwardly (in the right-left direction) toward each other. Rear walls 41 for respectively covering the rear ends of the retaining grooves 27 are formed integrally respectively at the opposite (right and left) side portions of the rear end of the cover body 33. The rear walls 41 can be fitted respectively in the notch portions 29 provided respectively above the retaining grooves 27 in the connector housing 1.

Therefore, a rear end surface 33*a* of the cover body 33 is disposed substantially flush with the rear end surface 1*a* of the connector housing 1. The overall length of the cover 17 (in the forward-rearward direction), including the cover body 33 and the closure portion 35, is substantially equal to the distance between the rear end surface 1*a* of the connector housing 1 and the rear wall 21 of the fitting hood 19.

For assembling this press-connecting connector, male metal terminals 43 are first received respectively in the terminal receiving chambers 3 before the cover 17 is attached. As a result of this receiving operation, resilient lances 13 of the metal terminals 43 are retainingly engaged respectively in the retaining holes 9, thereby positioning the metal terminals 43.

Then, wires 15 are located respectively above slots 43*a* of the metal terminals 43, and then are press-connected respectively to the slots 43*a* of the metal terminals 43. Then, the cover 17 is attached to the connector housing to cover the openings 15. By this attaching operation, the engagement projections 39, formed at the rear end of the cover 17, are engaged respectively in the retaining grooves 27 in the connector housing 1, and the cover 17 is engaged with the connector housing 1 in the upward-downward direction, and projections 12 are engaged respectively in recesses 10, so that the cover can be positioned in the forward-rearward direction.

When the cover 17 thus covers the openings 5, the rear walls 41 close the rear ends of the retaining grooves 27, respectively, and are fitted respectively in the notch portions 29, so that the rear end surface 33*a* of the cover 17 is disposed substantially flush with the rear end surface 1*a* of the connector housing 1. As a result of attachment of the cover 7, the closure portion 35 is held on the wall 7 to close the retaining holes 9.

In this condition, the front end of the cover 17 is substantially abutted against the rear wall 21 of the fitting hood 19, and the opposite side walls 37 rest respectively on the shelf portions 25, and corner portions 37*a* of the opposite side walls 37 are fitted respectively in the curved portions 23 of the connector housing 1. In this condition, opposite side walls 1*b* of the connector housing 1 are disposed substantially flush with the opposite side walls 37 of the cover 17, respectively.

As described above, since the retaining holes 9 are covered with the closure portion 35, foreign matters will not intrude through the retaining holes 9, and therefore the short-circuiting between the adjacent metal terminals 43 is prevented, and also the engagement of each resilient lance 13 in the retaining hole 9 is prevented from being canceled. The closure portion 35 is formed integrally with the cover 17, and therefore they can be handled as a one-piece structure during the assembling operation, and the assembling operation can be effected quite easily, and the number of the component parts is small, and the stock control for the parts is easy, and the cost can be reduced.

And besides, even though the closure portion 35 does not require any engagement structure on the part of the connector housing 1, the closure portion 35 can be positioned relative to the connector housing 1, utilizing the construction in which the engagement projections 39 of the cover 17 are engaged respectively in the retaining grooves 27, and therefore the common engagement structure is used, so that the construction is quite simple.

Second Embodiment

Figure 4:
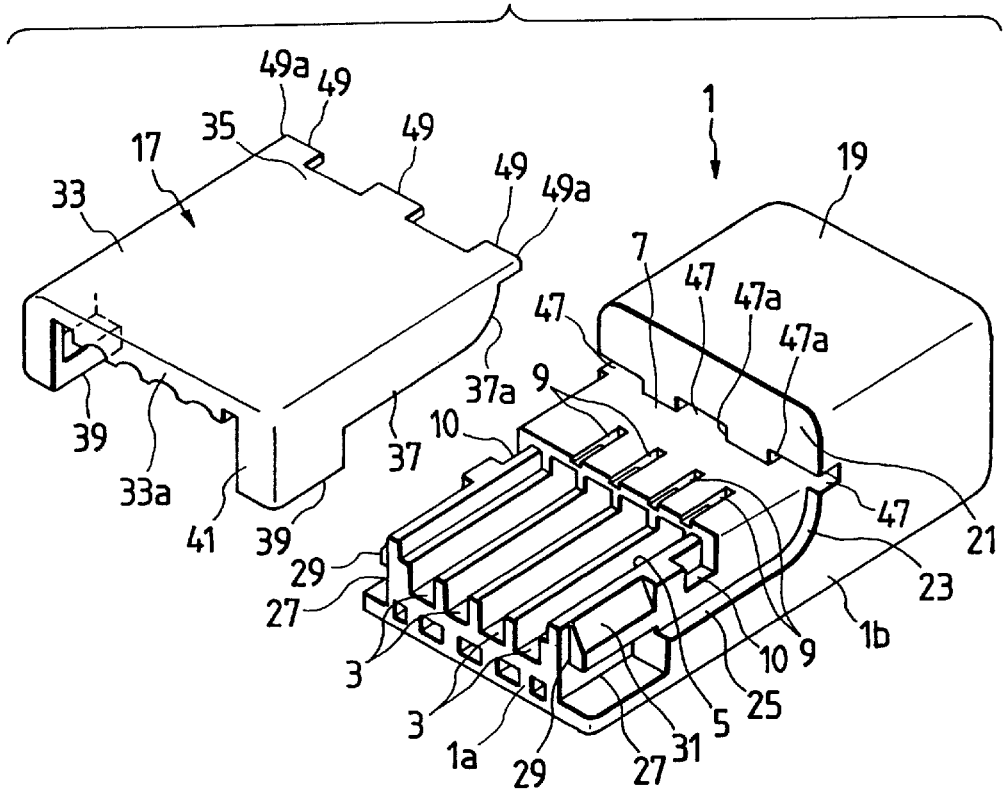
FIG. 4 is a perspective view of a second embodiment of the present invention, showing a condition in which a cover is detached from a connector housing.
Figure 5:
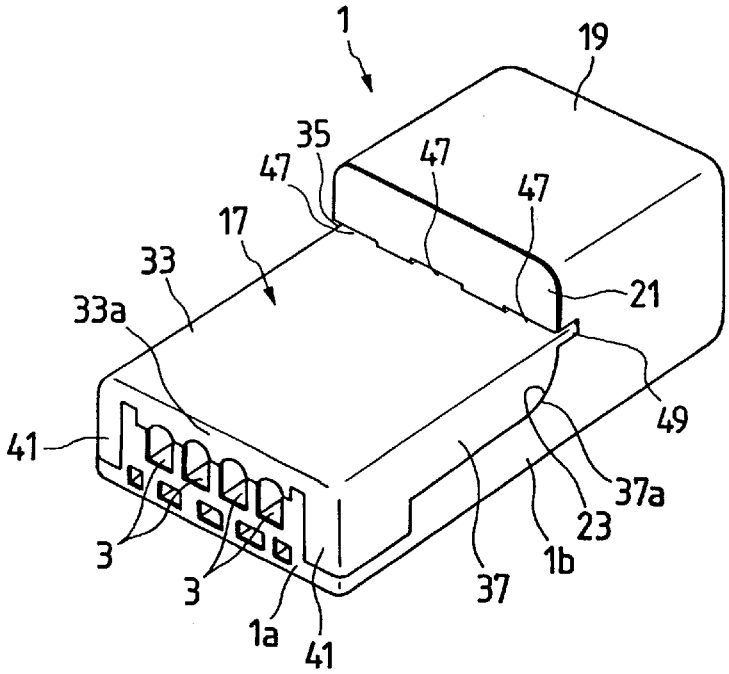
FIG. 5 is a perspective view of the second embodiment showing a condition in which the cover is attached.
Figure 6A:
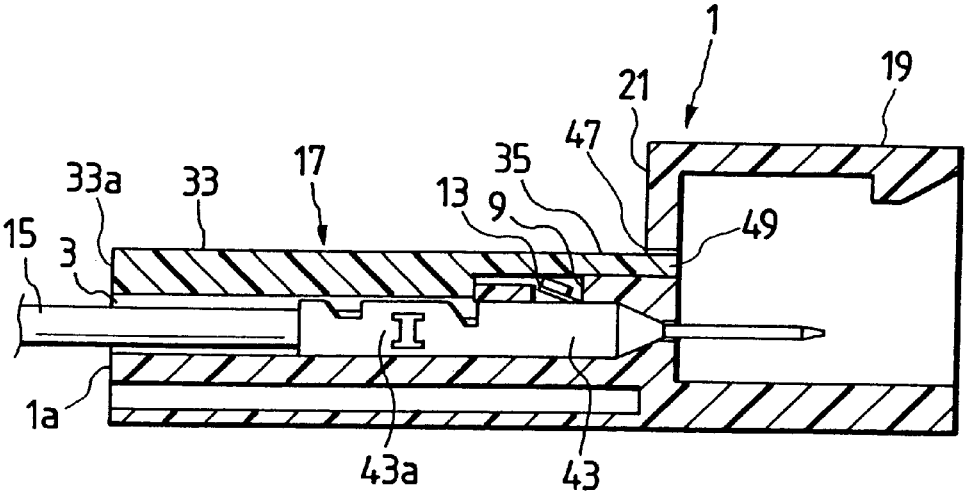
FIG. 6(*a*) is a cross-sectional view showing a condition in which the cover is attached, and FIG. 6(*b*) is a cross-sectional view showing a condition in which the cover is detached, and a press-connecting operation is not yet effected.
Figure 6B:
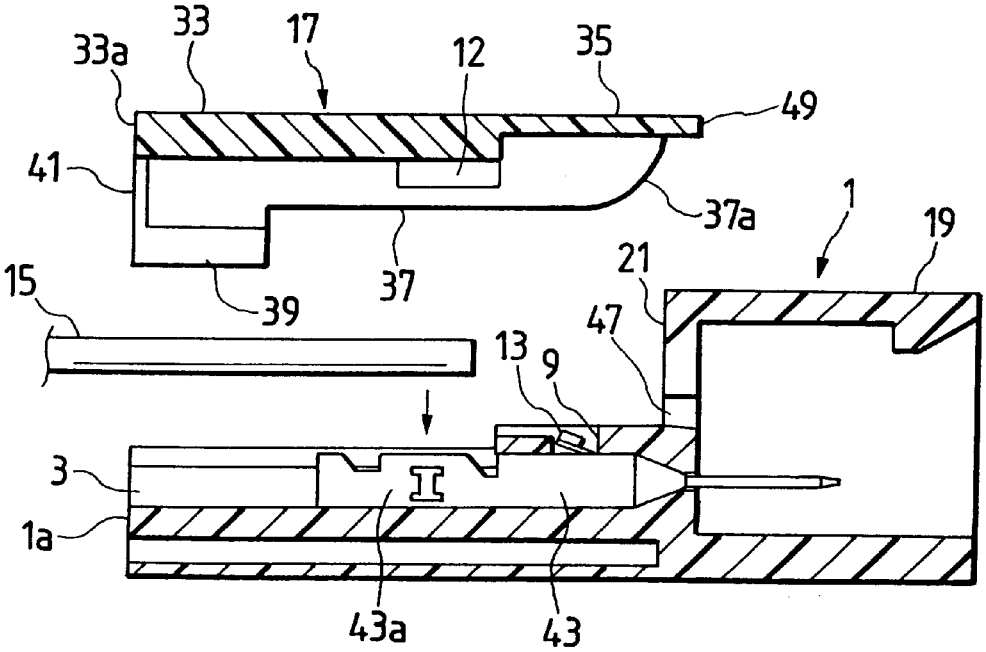

FIGS. 4 to 6 show a second embodiment of the invention, and FIG. 4 is a perspective view showing a condition in which a cover 17 is detached, FIG. 5 is a perspective view showing a condition in which the cover 17 is attached, FIG. 6(*a*) is a cross-sectional view showing the condition in which the cover 17 is attached, and FIG. 6(*b*) is a cross-sectional view showing a condition in which the cover 17 is detached, and wires are not yet press-connected. Those constituent portions, corresponding respectively to those of the first embodiment, will be designated by identical reference numerals, respectively, and detailed description thereof will be omitted.

In this embodiment, insertion reception portions 47 are formed in a wall 21, and insertion portions 49 are formed on a closure portion 35. The three insertion reception portions 47 are formed in opposite (right and left) side portions and a central portion of the wall 21, respectively, and these insertion reception portions 47 of a rectangular shape are formed by notching the wall 21. The opposite (right and left) side insertion reception portions 47 are open to the right and left sides, respectively. The three insertion portions 49, corresponding respectively to the insertion reception portions 47, are formed at the opposite (right and left) side portions and a central portion of the closure portion 35.

Therefore, when the cover 17 is attached to cover openings 5, engagement projections 39 of the cover 17 are retainingly engaged respectively in retaining grooves 27, and at the same time the insertion portions 49 are fitted respectively into the insertion reception portions 47, so that the closure portion 35 is retained on a connector housing 1. When the insertion portions 49 are thus inserted respectively into the insertion reception portions 47, a right side edge 49*a* of the right insertion portion 49 and a left side edge 49*a* of the left insertion portion 49 are disposed substantially flush with opposite side walls 1*b* of the connector housing 1, respectively.

Thus, the engagement projections 39 of the cover 17 are retainingly engaged respectively in the retaining grooves 27, and also projections 12 are engaged respectively in recesses 10, and as a result of insertion of the insertion portions 49 into the respective insertion reception portions 47, the closure portion 35 is engaged with a fitting hood 19 of the connector housing 1 in an upward-downward direction and a forward-rearward direction. Therefore, even when an external force acts on the cover 17, the closure portion 35 will not be turned upwardly on the retaining groove portions 27 (serving as a fulcrum), engaged with the engagement projections 39, by this external force, and therefore the cover 17 can be more firmly attached to the connector housing.

In this embodiment, the insertion portions 49 are engaged with right and left side edges 47*a* of the insertion reception portions 47, and therefore the insertion portions 49 are positioned also in the right-left direction, thereby positioning the cover 17 more accurately.

Third Embodiment

Figure 7:
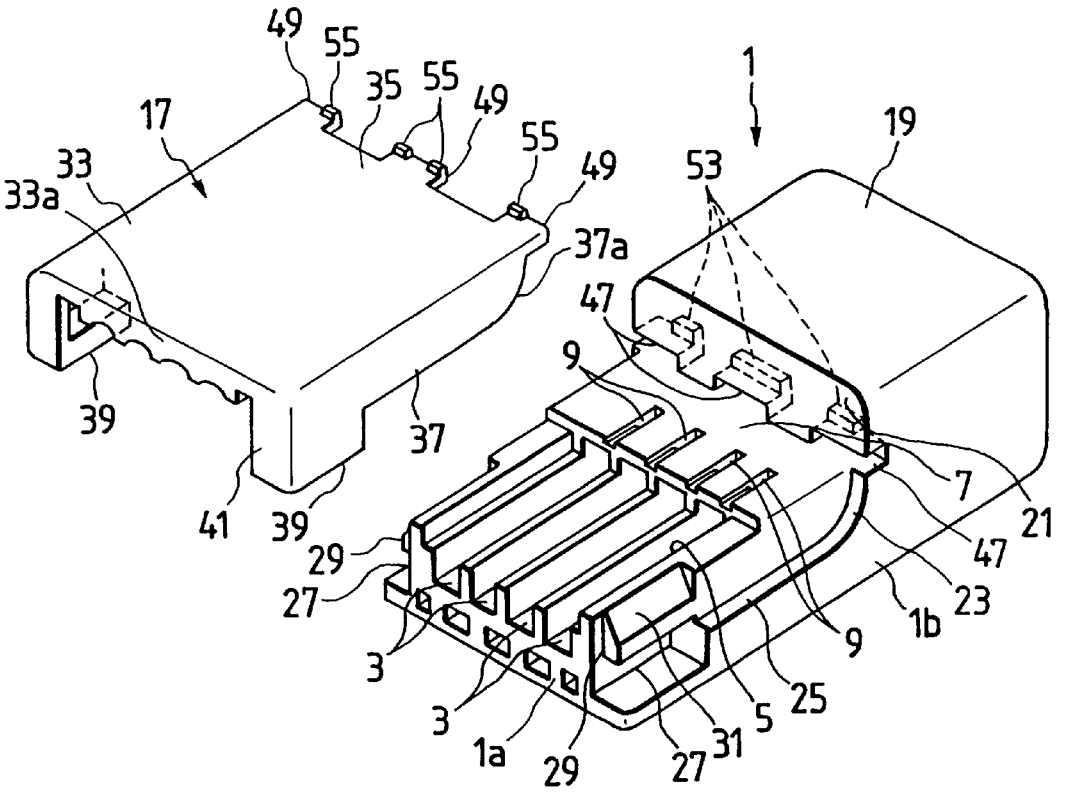
FIG. 7 is a perspective view of a third embodiment of the present invention, showing a condition in which a cover is detached from a connector housing.
Figure 8A:
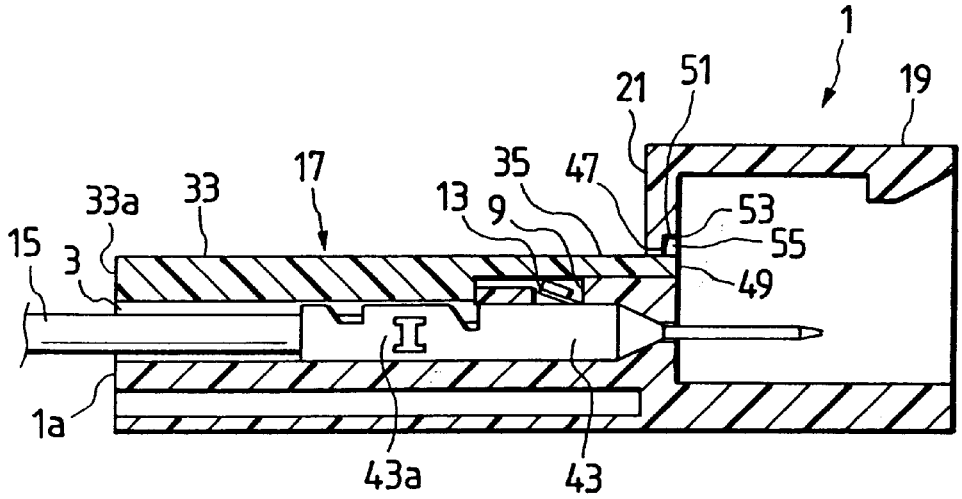
FIG. 8(*a*) is a cross-sectional view of the third embodiment showing a condition in which the cover is attached, and FIG. 8(*b*) is a cross-sectional view showing a condition in which the cover is detached, and a press-connecting operation is not yet effected.
Figure 8B:
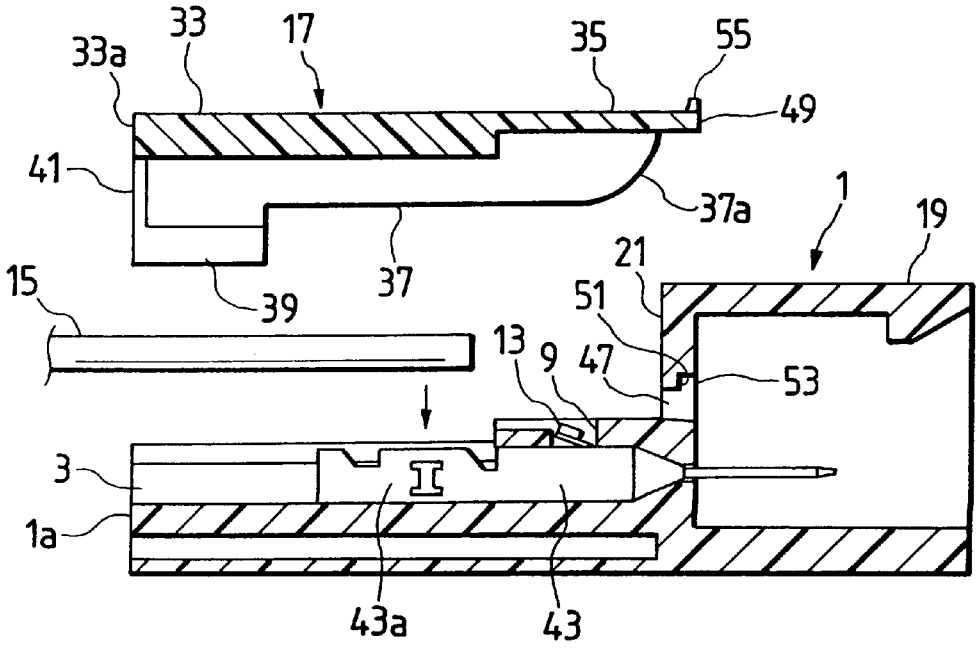
Figure 9:
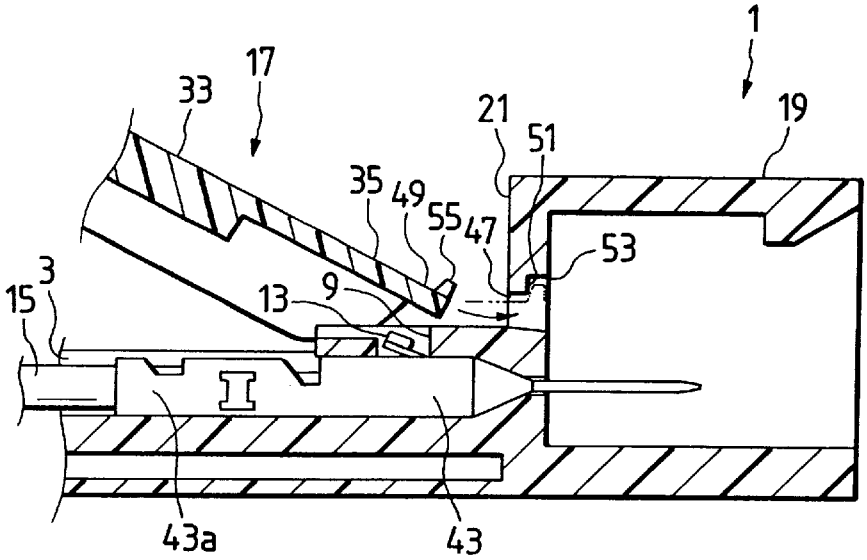
FIG. 9 is a cross-sectional view of the third embodiment, showing the manner of attaching the cover.

FIGS. 7, 8 and 9 show a third embodiment of the invention, and FIG. 7 is a perspective view showing a condition in which a cover 17 is detached, and FIGS. 8 and 9 are cross-sectional views.

Those constituent portions, corresponding respectively to those of the second embodiment, will be designated by identical reference numerals, respectively, and detailed description thereof will be omitted.

In this embodiment, a lock retaining recess 53, having a retaining surface 51 facing in a forward direction, is formed at an inner end of each of insertion reception portions 47, and a lock portion (or portions) 55 for engagement with the retaining surface 51 of the lock retaining recess 53 is formed on each of insertion portions 49.

Therefore, in this embodiment, wires 15 are press-connected respectively to metal terminals 43, and then the cover 17 is inclined, with its rear side raised, as shown in FIG. 9, and in this condition the insertion portions 49 are inserted respectively into the insertion reception portions 47, and then the cover 17 is turned downwardly so as to close openings 5, and the lock portions 55 are fitted into the respective lock retaining recesses 53 in the insertion reception portions 47. When the rear portion of the cover 17 is further pushed down, engagement projections 39, while guided and flexed respectively by guide surfaces 31, are moved into engagement with retaining grooves 27, respectively. Therefore, the lock portion (or portions) 55 of each insertion portion 49 is engaged with the associated retaining surface 51 in the forward-rearward direction in the insertion reception portion 47.

Therefore, in the third embodiment, in addition to the effects of the second embodiment, the rearward withdrawal of the cover 17 is positively prevented by the engagement of the lock portions 55 with the retaining surfaces 51, and the cover 17 can be attached more positively.

In the present invention, the retaining holes 9 are covered with the closure portion 35 simultaneously when the cover is attached, and the assembling operation and the maintenance are quite easy.

The cover and the closure portion are integral with each other, and therefore the number of the component parts is small, and the stock control for the parts is easy, and the cost can be reduced. When the cover 17 is engaged with the connector housing 1, the closure portion 35 can be positioned relative to the connector housing 1, and therefore the common engagement structure can be used, and the construction is extremely simple. And besides, the intrusion of foreign matters into the retaining holes 9 is prevented, and therefore the engagement of the resilient lance 13 is prevented from being accidentally canceled.

In the present invention, in addition to the effects of the invention of claim 1, the positioning of the closure portion 35 can be effected by the retaining portions 27 of the connector housing 1 and the engagement portions 39 of the cover, and the construction is quite easy, and the assembling operation and the maintenance are quite easy.

In addition to the effects of the present invention, the cover 17 can be retained on the connector housing 1 in a double manner, and the cover and the closure portion 35 can be attached more positively.

In addition to the effects of the present invention, the cover is retained relative to the connector housing in the upward-downward direction, and the closure portion is retained relative to the connector housing in the upward-downward direction and the forward-rearward direction, and by doing so, the cover and the closure portion can be more positively attached.

What is claimed is:

1. A press-connecting connector comprising:

a connector housing including a plurality of terminal receiving chambers;

openings formed in one side of each of said terminal receiving chambers at a rear portion thereof;

retaining holes formed on an upper wall of said connector housing for communicating the interior of an associated terminal receiving chamber with an exterior thereof, said retaining holes formed through one wall of each of said terminal receiving chambers and disposed forwardly of said openings;

resilient lances of a terminal, said resilient lances being accommodated in each of said terminal receiving chambers and engageable in an associated retaining hole;

a cover releasably engaged with said connector housing to cover said openings; and a closure portion for covering said retaining holes formed on and extending from a front end of said cover;

wherein said connector housing has a wall portion extending upwardly at a region disposed forwardly of said retaining holes, and insertion reception portions are formed in said wall portion, and insertion portions for being received respectively in said insertion reception portions are formed on said closure portion formed at the front end of said cover.

2. A press-connecting connector according to claim 1, in which retaining portions are formed respectively at opposite sides of said terminal receiving chambers of said connector housing, and engagement portions for being releasably engaged respectively with said retaining portions are formed respectively at opposite sides of said cover.

3. A press-connecting connector according to claim 2, in which said connector housing has a wall portion extending upwardly at a region disposed forwardly of said retaining holes, and insertion reception portions are formed in said wall portion, and insertion portions for being received respectively in said insertion reception portions are formed on said closure portion formed at the front end of said cover.

4. A press-connecting connector according to claim 3, in which said retaining portions are retaining grooves, respectively, which are formed respectively at opposite sides of said connector housing at a rear end portion thereof, and extend in a forward-rearward direction, and said engagement portions are engagement projections, respectively, which are formed respectively at the opposite sides of said cover at a rear end portion thereof, and extend in the forward-rearward direction, and a lock retaining portion, having a retaining surface facing in the forward direction, is formed in each of said insertion reception portions, and a lock portion for engagement with said retaining surface of the lock retaining portion is formed on each of said insertion portions.

5. A press-connecting connector according to claim 3, in which said retaining portions are retaining grooves, respectively, which are formed respectively at opposite sides of said connector housing at a rear end portion thereof, and extend in a forward-rearward direction, and said engagement portions are engagement projections, respectively, which are formed respectively at the opposite sides of said cover at a rear end portion thereof, and extend in the forward-rearward direction, and a lock retaining portion, having a retaining surface facing in the forward direction, is formed in each of said insertion reception portions, and a lock portion for engagement with said retaining surface of the lock retaining portion is formed on each of said insertion portions.

6. A press-connecting connector according to claim 3, in which said wall portion is a wall of a fitting hood of said connector housing.

7. A press-connecting connector according to claim 3, in which said wall portion is a wall of a fitting hood of said connector housing.

8. A press-connecting connector according to claim 4, in which said wall portion is a wall of a fitting hood of said connector housing.

9. A press-connecting connector according to claim 5, in which said wall portion is a wall of a fitting hood of said connector housing.

10. A press-connecting connector according to claim 1, further including:

notch portions formed in a rear end surface of the connector housing; and rear walls formed at a rear end of said cover, wherein said rear walls are fittable in said notch portions when said cover is engaged with said connector housing.

11. A press-connecting connector according to claim 1, further including shelf portions formed on outer sides of said terminal receiving chambers, wherein opposite side walls formed on said cover rest on said shelf portions when said cover is engaged with said connector housing.

12. A press-connecting connector according to claim 2, wherein guide surfaces are formed above said retaining portions for flexing said engagement projections and guiding said engagement projections into said retaining portions.

13. A press connecting connector according to claim 2, wherein said engagement portions extend downwardly from opposite side walls of said cover.

14. A press-connecting connector comprising:

a connector housing including a plurality of terminal receiving chambers;

openings formed in one side of each of said terminal receiving chambers at a rear portion thereof;

retaining holes formed on an upper wall of said connector housing for communicating the interior of an associated terminal receiving chamber with an exterior thereof, said retaining holes formed through one wall of each of said terminal receiving chambers and disposed forwardly of said openings;

resilient lances of a terminal, said resilient lances being accommodated in each of said terminal receiving chambers and engageable in an associated retaining hole;

a cover releasably engaged with said connector housing to cover said openings; and a closure portion for covering said retaining holes formed on and extending from a front end of said cover;

wherein said connector housing has a wall portion extending upwardly at a region disposed forwardly of said retaining holes, and insertion reception portions are formed in said wall portion, and insertion portions for being received respectively in said insertion reception portions are formed on aid closure portion formed at the front end of said cover.

15. A press-connecting connector comprising:

a connector housing including a plurality of terminal receiving chambers;

openings formed in one side of each of said terminal receiving chambers at a rear portion thereof;

retaining holes formed on an upper wall of said connector housing for communicating the interior of an associated terminal receiving chamber with an exterior thereof, said retaining holes formed through one wall of each of said terminal receiving chambers and disposed forwardly of said openings;

resilient lances of a terminal, said resilient lances being accommodated in each of said terminal receiving chambers and engageable in an associated retaining hole;

a cover releasably engaged with said connector housing to cover said openings; and a closure portion for covering said retaining holes formed on and extending from a front end of said cover;

wherein guide surfaces are formed above retaining portions formed respectively at opposite sides said terminal receiving chambers for flexing engagement projections and guiding said engagement projections into said retaining portions, wherein said engagement projections are releasably engaged with said retaining portions, and are formed at opposite sides of said cover.

* * * * *